United States Patent [19]

Barnwell

[11] Patent Number: 4,831,972

[45] Date of Patent: May 23, 1989

[54] INTERNAL COMBUSTION ENGINE

[76] Inventor: Edward A. Barnwell, P.O. Box 139, Ponte Vedra, Fla. 32082

[21] Appl. No.: 190,465

[22] Filed: May 4, 1988

[51] Int. Cl.[4] ..... F02B 71/00

[52] U.S. Cl. ..... 123/46 R; 123/193 R

[58] Field of Search ..... 123/193 P, 46 R, 46 B

[56] References Cited

U.S. PATENT DOCUMENTS

| | | | |
|---|---|---|---|
| 2,963,008 | 12/1960 | Waldrop | 123/46 A |
| 3,188,805 | 6/1965 | Gahagan | 123/46 R |
| 3,347,215 | 10/1967 | Pescara | 123/46 R |
| 3,501,087 | 3/1970 | Benaroya | 123/46 |
| 4,385,597 | 5/1983 | Stelzer | 123/46 A |

*Primary Examiner*—E. Rollins Cross

[57] ABSTRACT

Engine with a single oscillating piston body having five aligned piston portions operatively functioning in five aligned corresponding cylinder chambers, including a central large diameter double acting piston and cylinder, two intermediate diameter single acting pistons and cylinders, one on each side of the central piston; and two small diameter single acting end pistons and cylinders, each spaced outwardly from the respective intermediate pistons and cylinders.

15 Claims, 4 Drawing Sheets

INTERNAL COMBUSTION ENGINE

BACKGROUND OF THE INVENTION

Internal combustion engines have been known that operate on a single double-acting piston moving back and forth in a single cylinder. Such pistons are called "floating pistons" or "free pistons" although such pistons are generally fixed to a piston rod which extends outwardly from the cylinder to connect to mechanisms that can convert the linear force of the piston rod into useful energy.

In some instances there are three pistons and cylinders operating on a single piston rod in such a fashion that the two outer pistons serve to compress air for combustion in the central cylinder, first on one side and then on the other side of the double-acting piston. Such engines are described in U.S. Pat. No. 2,963,008 to Waldrop; U.S. Pat. No. 3,188,805 to Gahagan; and U.S. Pat. No. 4,385,597 to Stelzer. Because of the relative sizes of the cylinders and the connections between adjacent cylinders, the associated cylinder block is unduly complicated. Furthermore, there is no provision for employing the engine to produce other types of energy than mechanical.

It is an object of this invention to provide a novel internal combustion engine. It is another object to provide an engine having a novel design of a double-acting floating piston. Still other objects will appear from the more detailed description which follows.

BRIEF SUMMARY OF THE INVENTION

This invention relates to an internal combustion engine comprising a symmetrical floating differential multicomponent piston oscillating in a single multicompartment cylinder; said piston including a central double-faced piston portion, two intermediate piston portions spaced outwardly from the central piston portion and being smaller in diameter than said central piston portion, and two end piston portions spaced outwardly from said intermediate piston postions and being smaller in diameter than said intermediate piston portions; said multicompartment cylinder having a central chamber in which said central piston portion oscillates, two intermediate chambers in which said intermediate piston portions oscillate, and two end chambers in which said end piston portions oscillate; and suitable inlet and exit valved ports communicating each said chamber with outside of said multicomparment cylinder.

In specific preferred embodiments of the invention the engine is adapted to be a pneumatic compressor, an hydraulic pump or motor, or an electric generator.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 5:
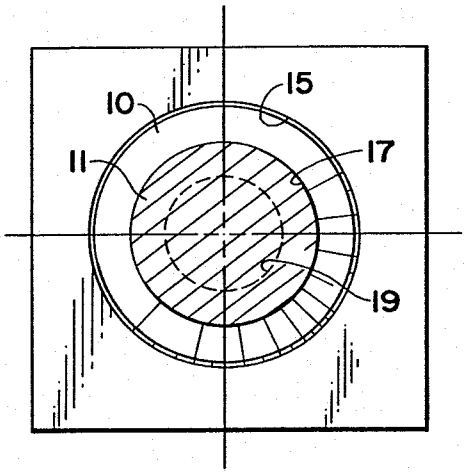
FIG. 5 is an end elevational view of the engine of FIG. 3 looking in the direction of 5—5 from the parting line.

The feature of this invention are best understood by reference to the attached drawings. In FIGS. 1–5 there are shown the piston and cylinder block of the invention. The simplified illustrations of FIGS. 3–5 are the easiest to understand.

The engine has a single multicomponent piston which moves back and forth in a two piece cylinder block. The piston actually has five component pistons; namely, a central double-ended piston 10, two intermedidate pistons 11 and 12, and two end pistons 13 and 14, all of which are symmetrical about longitudinal axis 20. These pistons operate respectively in a central cylinder 15, two intermediate cylinders 16 and 17, and two end cylinders 19 and 19. The pistons 10 and 14 move in cylinders 15 and 19 in the direction of arrows 29, first in one direction and then in the reverse direction to complete one cycle. In its preferred arrangement for functioning as an internal combustion chambers; cylinders 16 and 17 function as air compression chambers, and cylinder 15 functions as a pump cylinder to provide work output of the engine. A favorable feature of this engine is that it has a simple cylinder block of two portions 30 and 35. With the parting line 31 of the cylinder block at one end of central cylinder 15, the larger cylinder block portion 30 has three bored or counterbored chambers comprising central cylinder 15, intermediate cylinder 11, and end cylinder 19; while the smaller cylinder block portion 35 has only two bored or counterbored chambers comprising intermediate cylinder 16 and end cylinder 18. It is clear that this arrangement provides a great economy in the manufacture of the engine. Parting line 31 may be positioned elsewhere along the axial length of cylinder 15 and it will merely mean that both of cylinder block portions will have three chambers.

It is also intended that this invention cover other arrangements than that described above of five pistons in five cylinders with the specific functions as noted. This engine can also function with three pistons and three cylinders; namely central double acting piston 10 operating in central cylinder 15 and two end pistons 13 and 14 operating in two end cylinders 18 and 19, with no intermediate pistons 11 and 12 and no intermediate cylinders 16 and 17. Still another alternative to the arrangement described above for FIGS. 3–5 is that the functions of each piston and its cylinder may be changed. For example, central piston 10 and central cylinder 15 may be used for air compression or combustion chambers; intermediate pistons 11 and 12 and their intermediate cylinders may be used as pumps or combustion chambers; and end pistons 13 and 14 and their cylinders 18 and 19 may be used as air compressors or pumps. It is, of course, only necessary to employ one set of pistons and cylinders for combustion chambers, another set for air compessors, and another set for whatever purpose desired, e.g. pumps.

Figure 2:
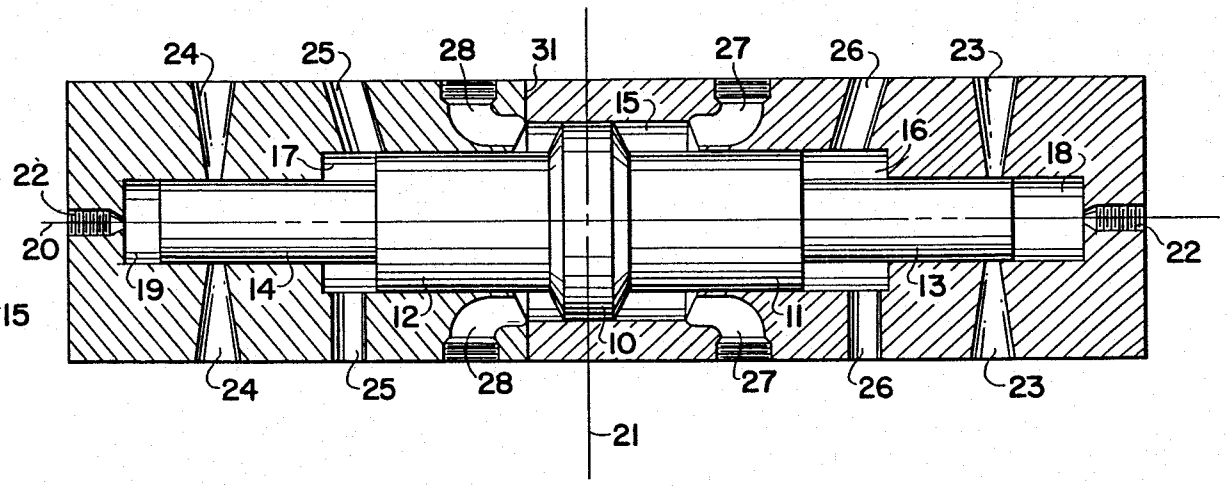
FIG. 2 is a cross sectional view taken at 2—2 of FIG. 1.
Figure 1:
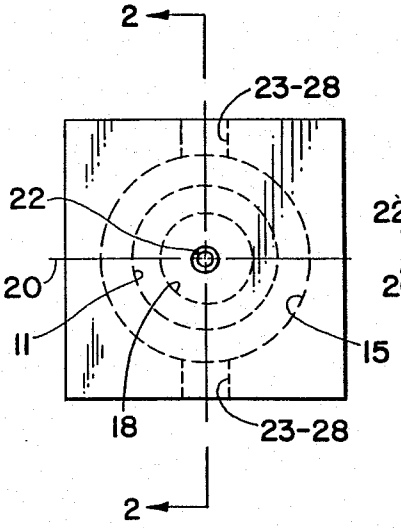
FIG. 1 is an end elevational view of the piston and cylinder block of the engine of this invention.
Figure 3:
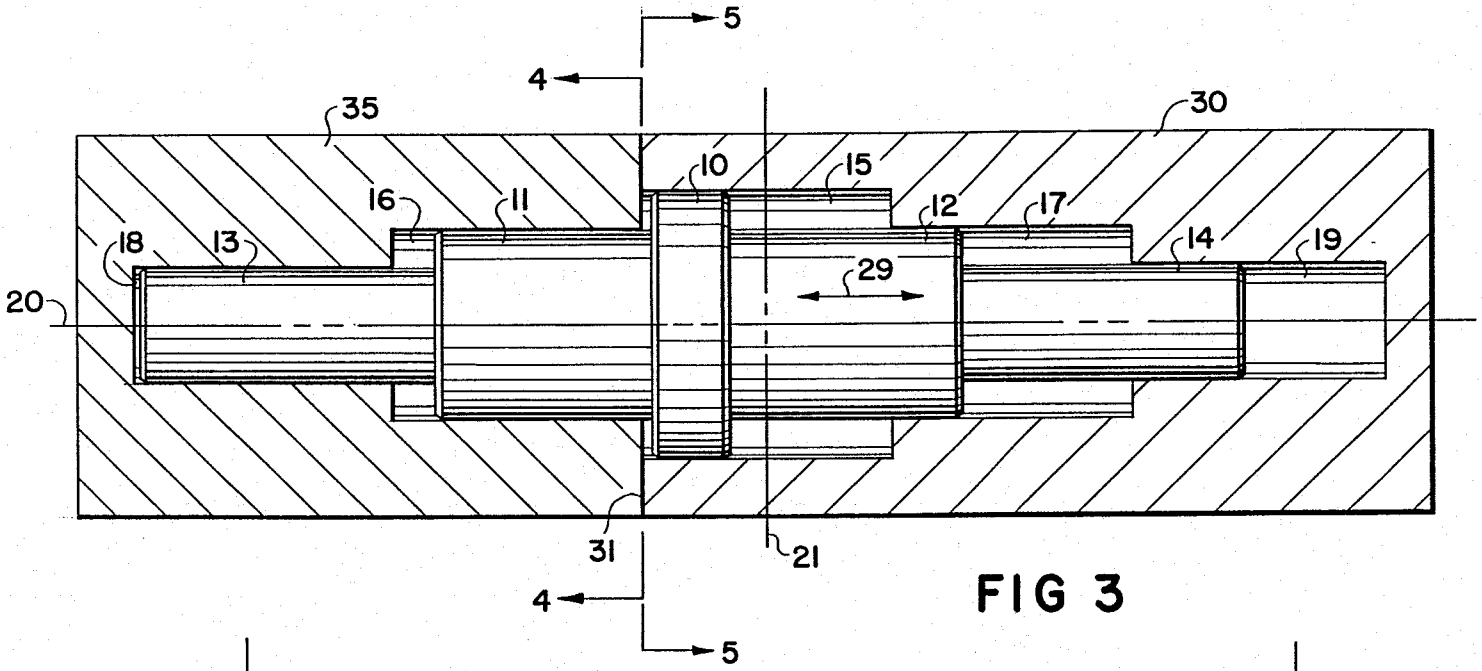
FIG. 3 is a cross sectional view similar to that of FIG. 2, but simplified by eliminating all inlet and outlet ports.
Figure 4:
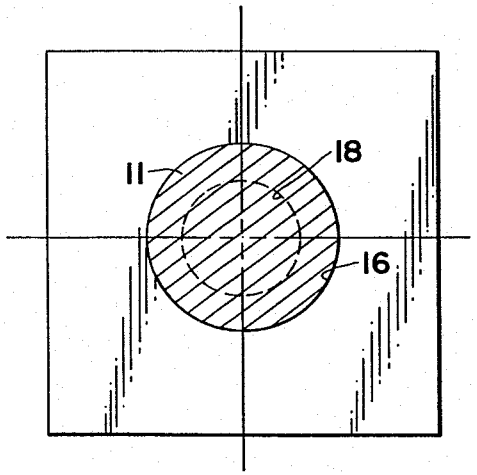
FIG. 4 is an end elevational view of the engine of FIG. 3 looking in the direction of 4—4 from the parting line.

In FIGS. 1 and 2 there is shown the same general engine as just described with respect to FIGS. 3–5, except to show various ports and communications needed to make the engine operable. There must be a spark producing device or other means for inducing combustion, such as a glow plug for diesel fuel or a port for fuel injector engines, for combustion chambers 18 and 19 to function as such. Tapped holes 22 are intended to provide a position for a spark plug or other combustion inducing device in each combustion chamber. Furthermore, there must be an entrance for fuel and air to be admitted into the combustion chamber and an exit for conducting exhaust gases away from the combustion chamber. Ports 23 and 24 serve these purposes for cylinders 18 and 19 respectively. It is also necessary to have valves in ports 23 and 24 and timing devices to open and close such valves at the appropriate times for smooth operation of the engine. These valves and timing devices form no part of the invention because they are well known and commercially available. Accordingly, they are not shown in the attached drawings.

Ports 25 and 26 are entrances and exits from intermediate cylinders 16 and 17, respectively. These cylinders and the cooperating pistions 11 and 12 are preferably employed to precompress air to be used in the combustion of fuel in chambers 18 and 19. One port 25 or 26 is an entrance passageway for air, and the other port 25 or 26 in an exit passageway for compressed air. These ports all require suitable valves which are not shown because they, too, are conventional commercial devices.

Ports 27 and 28 communicate with the two ends of central cylinder 15. One of each pair of ports 27 and 28 is an exit. It is, of course, necessary to have an entrance and an exit from each portion of cylinder 15, the portions being separated by central piston 10. The function of central piston 10, central cylinder 15, and ports 27 and 28 is to pressurize and pump a suitable fluid, e.g. a gas or a liquid. Since central piston 10 is double-acting there will be a pumping stroke for each movement of central piston 10 toward one end or the other end of central cylinder 15. If a gas is pumped by piston 10, the engine is a pneumatic pump to be used in any of a variety of way, e.g. to compress the gas, to operate pneumatic tools, or the like. If a liquid, such as oil, is pumped by piston 10, the engine may be used to operate hydraulic tools and equipment or the like.

Figure 7:
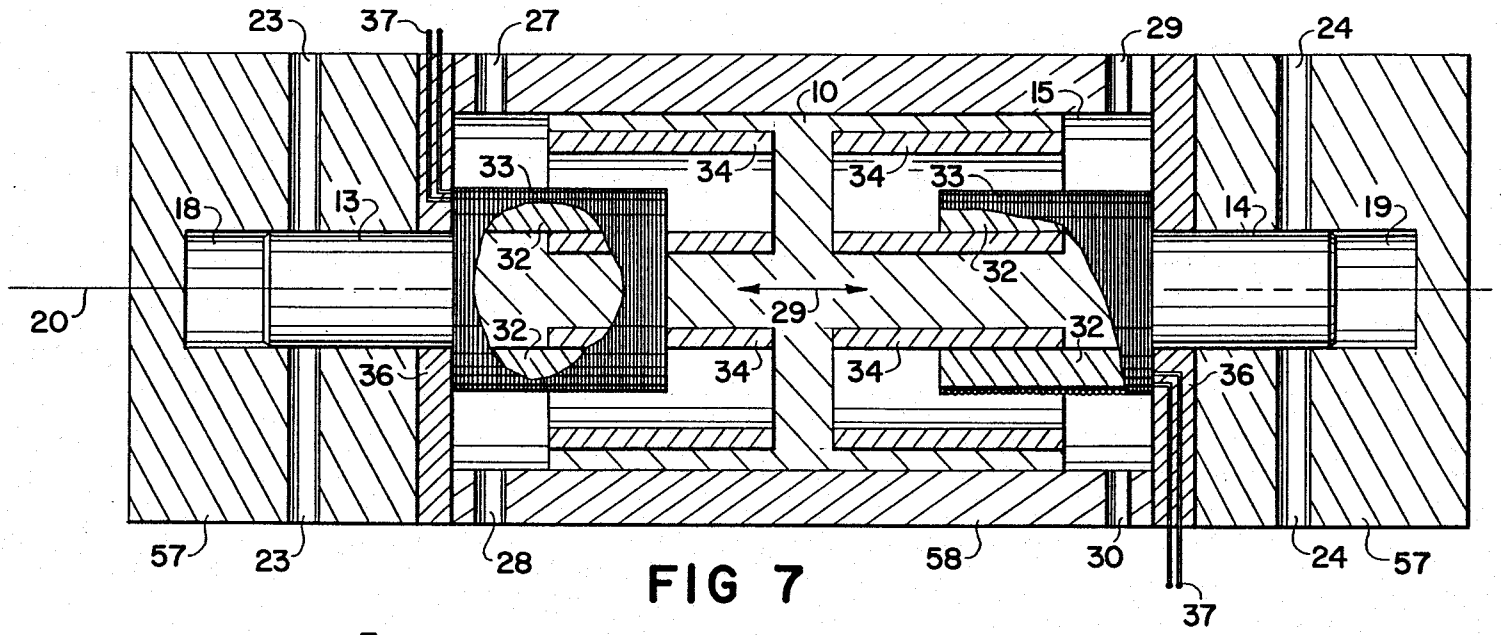
FIG. 7 is a cross sectional view taken at 7—7 of FIG. 6.
Figure 6:
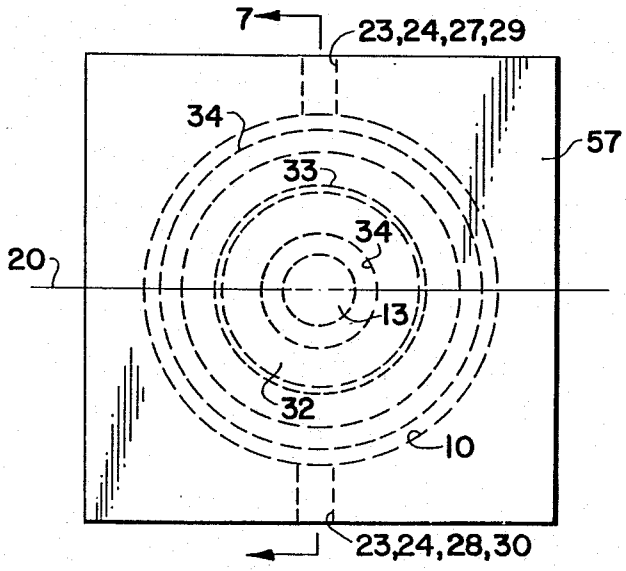
FIG. 6 is an end elevational view of a second embodiment of this engine for functioning as an electric generator.

In FIGS. 6 and 7 there is shown a second embodiment for the engine of this invention; namely that of an electric generator. In this embodiment there is a single multicomponent piston oscillating back and forth in a cylinder block comprising central portion 58 and two end portions 57, which differ only slightly from the block in the engine of FIGS. 1–6. Central piston 10 moves in central cylinder 15 and two end pistons 13 and 14 move in end cylinders 18 and 19. Central piston 10 is fitted with two rings 34 of magnets, either permanent magnets or electromagnets. These magnet rings 34 may each be a single, cylindrical ring or a plurality of strip magnets placed side by side to form the equivalent of a cylindrical ring. In any event, magnet rings 34 are rigidly attached to piston 10 and move with piston 10. A coil of wire 33 is stationary and supported on a flanged tubular support 32, the inside diameter of which may function as a bushing for the shaft of piston 10, or may merely be a closely fitting tube not touching the shaft of piston 10. Lateral flange 36 of tubular support 32 is convenient as a manufacturing aid, but is not necessary to the functioning of coil 33 or support 32. As pistons 10, 18, and 19 move back and forth in the directions of arrows 29 magnet rings 34 move in and out of close proximity to coil 33 causing the induction of electricity in coil 33, which can be drawn off from terminals 37 for external use elsewhere. Cylinders 18 and 19 are combustion chambers for providing power from the engine to move the pistons 10, 13, and 14 as explained above. Ports 23 and 24 are inlet and exit passageways for bringing fuel and air into the combustion chamber and conducting exhaust gases out of the combustion chamber as explained above. Valves, timing devices, and spark plugs are needed to operate this internal combustion engine, but are not shown because they are conventional commercial devices. Ports 27–30 are for inlet and exit passageways to and from cylinder 15. These may serve to precompress air for use in the combustion chambers 18 and 19. If not needed for that purpose, ports 27–30 may be needed for breathing purpose to prevent any buildup of back pressure against the movement of central piston 10. If central cylinder 15 can be evacuated of air, ports 27–30 may be permanently closed.

Figure 8:
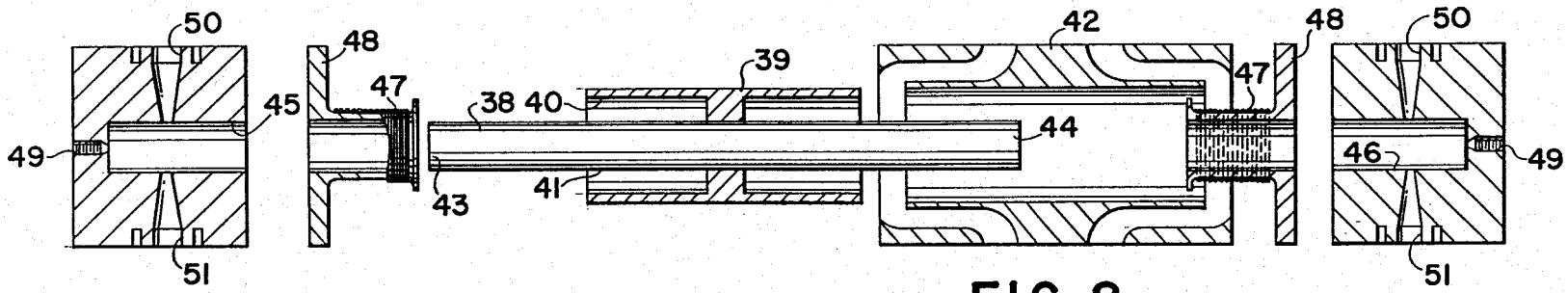
FIG. 8 is a schematic exploded view of the generator embodiment shown in assembled form in FIG. 9.
Figure 9:
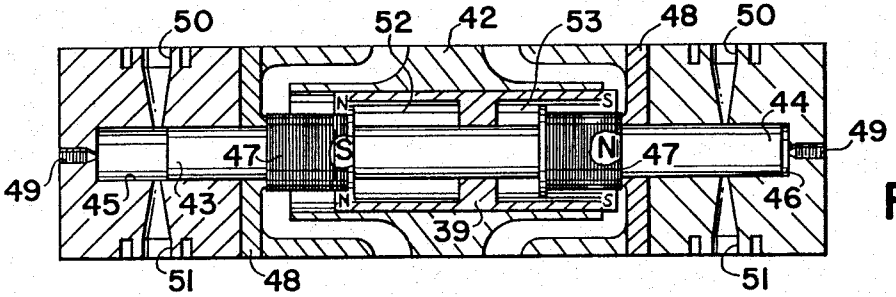
FIG. 9 is a schematic view of a third embodiment of this invention as an electric generator.
Figure 10:
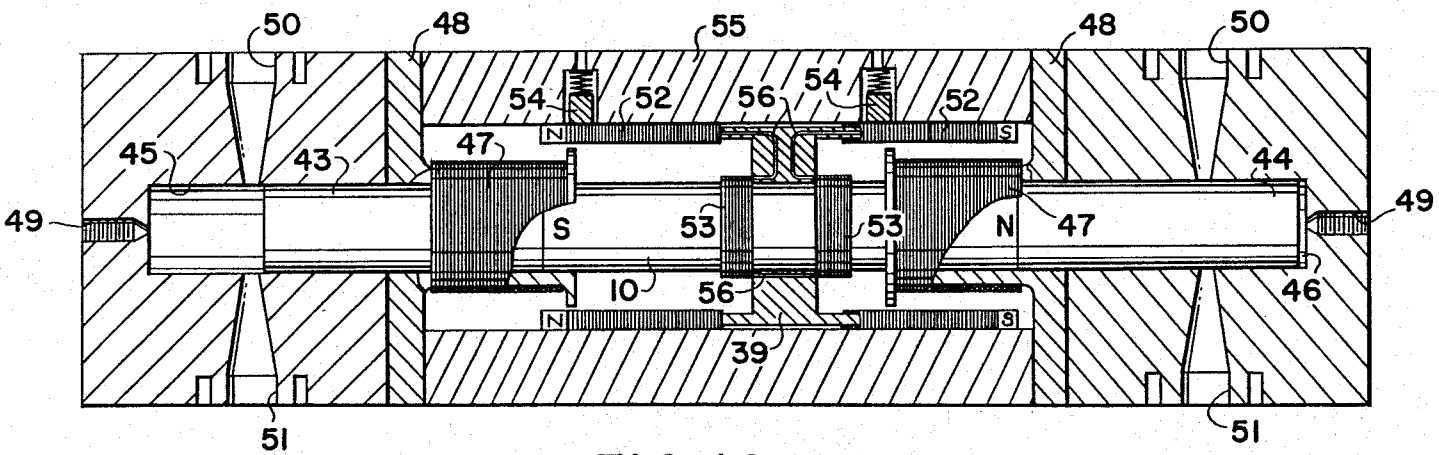
FIG. 10 is a schematic view of a fourth embodiment of this invention as an electric generator.

In FIGS. 8–10 there are shown two types of internal combustion engines of this invention operable as electric generators. The version shown in FIGS. 8 and 9 employs permanent magnets and the version in FIG. 10 employs an electromagnet.

FIGS. 8 and 9 are two views of the same machine. FIG. 8 is an exploded view of FIG. 9. A piston rod 38 has rigidly attached to its central portion a hollow cylindrical member 39 which is a permanent magnet or is a structure with permanent magnets attached to its surfaces 40 and 41. The two ends 43 and 44 of piston rod 38 operate in cylinders 45 and 46, respectively, to form combustion chambers with a port 49 for a spark plug, a port 50 for an inlet of a fuel/air mixture, and an outlet port 51 for exhaust gases to exit. A coil of wire 47 wound on a holder 48 encircles piston rod 10 intermediate between ends 43 and 44 and central magnet member 39. When these parts are assembled as shown in FIG. 9 it can be seen that piston rod 10 oscillates back and forth according to the alternate firing in combustion chambers 45 and 46. When this happens the hollow magnetic member 39 moves back and forth through coils 47 inducing an electric current in each. This current can be drawn off continuously as long as the engine is running. If desired the outside surface of member 39 and the inside surface of cylinder 42 can be made with each small tolerances that they form a double acting piston operating in cylinders 52 and 53, useful as air compressors to prepare the air for the fuel/air mixture fed to combustion chambers 45 and 46. If, however, a separate source of compressed air is used, cylinder 42 structure can be omitted.

In FIG. 10 a structure similar to that of FIGS. 8 and 9 is shown except that the magnetic hollow cylindrical member is an electromagnet rather than a permanent magnet. Piston rod 10 has a central hollow cylindrical member 39 and two end pistons 43 and 44 operating in cylinders 45 and 46, each having a spark plug port 49, a fuel inlet port 50 and an exhaust outlet port 51, all similar to that described above with respect to FIGS. 8–9. Hollow cylindrical brush holder 55 fits closely around hollow magnet member 39, having wire coils 52 around the extremities thereof. Coil 52 is connected electrically by wires 56 to coil 53 around the central portion of piston rod 10. As piston rod 10 and end pistons 43 and 44 oscillate back and forth by firing of combustion chambers 45 and 46, brushes 54 carry electric current to coils 52 and 53 causing the core around which the coil is wound to be magnetized. Thus the outer extremities of member 39 and the central portions of piston rod 10 become electromagnets. As these magnetized members move right and left they generate electricity in coils 47 which can be drawn off for use as described above.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. An internal combustion engine comprising a symmetrical floating differential multicomponent piston oscillating in a single multicomparment cylinder; said piston including a central double-faced piston portion, and two end piston portions spaced outwardly from said central piston and being smaller in diameter than said central piston; said multicompartment cylinder having a central chamber in which said central piston portion oscillates, and two end chambers in which said end piston portions oscillate; and suitable inlet and exit valved ports communicating each said chamber with outside of said multicompartment cylinder.

2. The engine of claim 1 which additionally comprises two intermediate piston portions spaced between said central piston and said end piston portions and operating in intermediate chambers in which said intermediate piston portions oscillate.

3. The engine of claim 1 having a two-piece cylinder block which fits together along a longitudinal plane through the longitudinal axis of said multicomponent cylinder.

4. The engine of claim 1 having a two-piece cylinder block which fits together along a lateral plane perpendicular to the longitudinal axis of said multicomponent cylinder through said central piston portion.

5. The engine of claim 2 wherein said central chamber, said central piston portion, and associated said inlet and exit valved ports comprise an hydraulic pump.

6. The engine of claim 2 wherein said central chamber, said central piston portion, and associated said inlet and exit valved ports comprise a pneumatic compresser.

7. The engine of claim 1 wherein said central chamber includes a coil of electricl conducting wire extending over a substantial portion of its axial length; and said central piston portion includes permanent magnets covering a substantial portion of its outside surface, said magnets being adapted to induce electricity in said coil as said central piston portion oscillates therein.

8. The engine of claim 1 wherein said end chambers are adapted to function as combustion chambers and each of said end chambers has a third port to receive a spark plug.

9. The engine of claim 2 wherein said intermediate chambers are adapted to function as air compressors to compress air for use in said combustion chamber mixed with fuel.

10. The engine of claim 1 wherein said central chamber includes two sets of said inlet and exit valved ports, each set positioned at the end of said central chamber near the adjacent intermediate chamber.

11. An internal combustion engine driven electric generator comprising a symmetrical multicomponent piston oscillating in a corresponding multichamber cylinder; including a central double-acting piston oscillating in a central cylinder, and two end pistons integral with said central piston and oscillating in two end cylinders respectively, which are adapted to function as internal combustion chambers; said central piston including magnets rigidly attached thereto and said central cylinder including a coil of electrically conducting wire mounted therein with each turn of wire in said coil lying generally in a plane perpendicular to the axis of said pistons and lying in close proximity to said magnets.

12. The generator of claim 11 wherein said magnets are permanent magnets attached to said central piston.

13. The generator of claim 11 wherein said magnets are electromagnets energized through electricity introduced by brushes to coils of wire mounted on said central piston.

14. The generator of claim 13 wherein said central piston comprise a cylindrical tubular portion mounted coaxially on a central shaft with said tubular portion having a coil of wire mounted thereon in contact with said brushes.

15. The generator of claim 12 wherein said central piston includes a central cylindrical tubular portion rigidly connected coaxially to a shaft portion which joins integrally with said two end pistons; said tubular portion being spaced concentrically outwardly from said shaft portion; said central cylinder including two said coils of wire adapted to permit said shaft portion to oscillate inside said coils and to permit said tubular portion to oscillate outside said coils; said shaft portion and said tubular portion being covered with permanent magnets on the side facing said coils.

* * * * *